US006469458B1

(12) United States Patent
Nozawa et al.

(10) Patent No.: US 6,469,458 B1
(45) Date of Patent: Oct. 22, 2002

(54) DEFLECTION YOKE AND A METHOD OF WINDING A DEFLECTION COIL

(75) Inventors: Takahiro Nozawa, Ryugasaki (JP); Yoshihiko Wada, Ibaraki-ken (JP); Keiji Morimoto, Toride (JP); Kenichi Ikeda, Iwai (JP); Naoki Hatakeyama, Ibaraki-ken (JP)

(73) Assignee: Victor Company of Japan, Ltd., Yokohama (JP)

( * ) Notice: Subject to any disclaimer, the term of this patent is extended or adjusted under 35 U.S.C. 154(b) by 0 days.

(21) Appl. No.: 09/116,251

(22) Filed: Jul. 16, 1998

(30) Foreign Application Priority Data

| | | |
|---|---|---|
| Jul. 22, 1997 | (JP) | 9-211403 |
| Jul. 30, 1997 | (JP) | 9-219114 |
| Jan. 7, 1998 | (JP) | 10-013398 |
| Jan. 30, 1998 | (JP) | 10-033660 |

(51) Int. Cl.[7] ..... G09G 1/04

(52) U.S. Cl. ..... 315/370; 315/399; 315/382.1; 313/440; 313/412; 313/413; 313/428

(58) Field of Search ..... 315/370, 368.28, 315/368.25, 364, 368.11, 399; 313/440, 312, 412, 413, 428

(56) References Cited

U.S. PATENT DOCUMENTS

| | | | | |
|---|---|---|---|---|
| 5,138,238 A | * | 8/1992 | Truskalo | 315/368.18 |
| 5,166,576 A | * | 11/1992 | Roussel et al. | 313/431 |
| 5,397,968 A | * | 3/1995 | Ito et al. | 315/368.28 |
| 6,201,360 B1 | * | 3/2001 | Misonou | 315/400 |

FOREIGN PATENT DOCUMENTS

| | | |
|---|---|---|
| JP | 2-215031 | 8/1990 |
| JP | 3089434 | 4/1991 |
| JP | 7-162880 | 6/1995 |

* cited by examiner

*Primary Examiner*—Don Wong
*Assistant Examiner*—Tuyet T. Vo
(74) *Attorney, Agent, or Firm*—Louis Woo

(57) ABSTRACT

Auxiliary deflection coils are connected to horizontal deflection coils. Each auxiliary deflection coil is disposed in the intermediate region between the inner peripheral end adjacent to a window and the outer peripheral end. Each horizontal deflection coil is dividable into three regions extending from its winding introductory part to its winding terminal part. A variable inductance coil is connected in parallel with the intermediate region to control the horizontal deflection current flowing across the horizontal deflection coil. The variable inductance coil has a cylindrical core installed in a hollow space of a bobbin and a coil connected in parallel with the auxiliary coil. A disc core is provided adjacent to the coil. The disc core has an end face larger in area than an end face of the cylindrical core.

5 Claims, 10 Drawing Sheets

DEFLECTION YOKE AND A METHOD OF WINDING A DEFLECTION COIL

BACKGROUND OF THE INVENTION

The present invention relates to a deflection yoke installed in an in-line color television picture tube.

In a picture display apparatus using an in-line color television picture tube equipped with three electron guns, it is necessary to converge the three electron beams produced from the three electron guns on a screen surface. To this end, a conventional convergence method uses a self-convergence type deflection yoke. The self-convergence type deflection yoke generally comprises a pair of upper and lower saddle type horizontal deflection coils and a pair of right and left saddle type vertical deflection coils to realize a desirable convergence performance.

However, a practical problem arises when the deflection yokes are mass produced. Convergence errors may occur due to dispersion in the performance of mass-produced saddle coils. To correct such convergence errors, an adequate adjustment is performed by attaching a magnetic piece to an appropriate portion of the coil or using a correction circuit.

FIGS. 13A and 13B show typical convergence errors caused by the dispersion of the horizontal deflection field. FIG. 13A shows a pincushion type convergence error of an X (i.e., horizontal) axis. The pincushion type convergence error appears when the pincushion of the horizontal deflection field is excessively strong. FIG. 13B is a barrel type convergence error of the X axis that is found when the pincushion of the horizontal deflection field is excessively weak. In FIGS. 13A and 13B, each solid line represents a vertical bright line of red and each dotted line represents a vertical bright line of blue. The convergence errors shown in FIGS. 13A and 13B are generally referred to as "XH convergence errors."

Unexamined Japanese Patent Application No. Kokai 2-215031, published in 1990, discloses a conventional deflection yoke used for collecting this kind of XH convergence error. As shown in FIG. 14, this conventional deflection yoke comprises a horizontal deflection coil 1 consisting of a main coil 1*a* and an auxiliary coil 1*b*. The auxiliary coil 1*b* serves as a winding introductory part or a winding terminal part of the main coil 1*a*. A variable inductance coil 2 is connected in parallel with the auxiliary coil 1*b*. This arrangement requires intermediate taps 3 provided in the horizontal deflection coil 1.

According to this conventional arrangement, the variable inductance coil 2 functions as a bypass circuit which has the capability of controlling a horizontal deflection current flowing across the auxiliary coil 1*b* connected in parallel with the variable inductance coil 2. This makes it possible to adjust a magnetic field generated at the horizontal deflection coil. With this arrangement, it becomes possible to correct the XH convergence error shown in FIGS. 13A and 13B.

FIG. 15 is a plan view showing a deflection yoke seen from an outlet (i.e., larger-diameter) side of electron beam. A funnel or bell-mouthed separator 4 accommodates a pair of upper and lower horizontal deflection coils 1 along an inner surface thereof. Each horizontal deflection coil 1 is formed into a saddle shape with a window 5. The upper and lower horizontal deflection coils 1 are opposed each other via a butt portion 6.

The auxiliary coil 1*b* shown in FIG. 14 may be disposed at a region A adjacent to the window 5 corresponding to the inner peripheral portion of the horizontal deflection coil 1 shown in FIG. 15 to decrease the horizontal deflection current in the region A. This arrangement enhances the pincushion of the horizontal deflection field. It becomes possible to correct the barrel convergence error shown in FIG. 13B.

However, controlling the current of a limited section adjacent to the window 5 may cause a difference between a convergence variation on the X-axis of the screen and a convergence variation at the corner of the screen. FIG. 16 shows a convergence error still remaining even after the XH convergence error is corrected according to this conventional correcting method.

On the other hand, the auxiliary coil 1*b* shown in FIG. 14 may be disposed at a region B adjacent to the outer peripheral portion of the horizontal deflection coil 1 shown in FIG. 15 to control the horizontal deflection current in the region B. However, even in this arrangement, the convergence error appears as shown in FIG. 16.

SUMMARY OF THE INVENTION

An object of the present invention is to provide a deflection yoke capable of adequately correcting the XH convergence error.

Another object of the present invention is to provide a deflection yoke simple when it is assembled.

Another object of the present invention is to provide a winding method of deflection coil.

Another object of the present invention is to provide a deflection yoke having a sufficiently enlarged variable range in the inductance for adequately correcting the XH convergence error, without increasing the turn number of the coil or the length of the core unnecessarily.

In order to accomplish the above and other related objects, a first aspect of the present invention provides a deflection yoke comprising at least one saddle type horizontal deflection coil, characterized in that each horizontal deflection coil has at least three regions extending from a winding introductory part to a winding terminal part, and a control device is provided for controlling a horizontal deflection current flowing across a predetermined intermediate region of the horizontal deflection coil.

Preferably, the control device is a variable inductance coil connected in parallel with the intermediate region of the horizontal deflection coil.

A second aspect of the present invention provides a deflection yoke comprising a pair of saddle type horizontal deflection coils, wherein a pair of auxiliary deflection coils are connected to the horizontal deflection coils and disposed in a region between an inner peripheral portion of the horizontal deflection coils adjacent and a yoke window and an outer peripheral portion of the horizontal deflection coils.

Preferably, the auxiliary deflection coils overlap with the horizontal deflection coils. The deflection yoke may further comprises a control device for controlling the horizontal deflection current flowing across the auxiliary deflection coils. Preferably, the control device is a variable inductance coil connected in parallel with the auxiliary deflection coils. Furthermore, it is preferable that an electric wire used for the auxiliary deflection coils is differentiated in at least one of color, wire diameter and strand pitch from an electric wire used for the horizontal deflection coils.

A third aspect of the present invention provides a method of winding a horizontal deflection coil installed in a deflection yoke, comprising a step of winding the horizontal deflection coil in a cylindrical fashion from one end to the other end, and further comprising a step of winding an auxiliary deflection coil in addition to the horizontal deflection coil in an intermediate region between the one end and the other end, the auxiliary deflection coil being connected to the horizontal defection coil.

Preferably, the auxiliary deflection coil is wound together with the horizontal deflection coil, or wound independently of the horizontal deflection coil. It is also preferable that the electric wire used for the auxiliary deflection coil is differentiated in at least one of color, wire diameter and strand pitch from the electric wire used for the horizontal deflection coil.

A fourth aspect of the present invention provides a variable inductance coil comprising a bobbin having a hollow space, a first core installed in the hollow space of the bobbin and shiftable in a longitudinal direction of the hollow space, a coil connected in parallel with an auxiliary deflection coil and wound around the bobbin, and a second core having an end surface larger in area than an end surface of the first core, the second core being disposed adjacent to an end portion of the hollow space.

Preferably, the second coil is independent of or integral with the first core. The variable inductance coil may be incorporated in a deflection yoke comprising an auxiliary deflection coil connected to a horizontal deflection coil and disposed in the region between the window corresponding to the inner peripheral portion of the horizontal deflection coil and the outer peripheral portion of the horizontal deflection coil. The variable inductance coil controls the horizontal deflection current flowing across the auxiliary deflection coil.

BRIEF DESCRIPTION OF THE DRAWINGS

The above and other objects, features and advantages of the present invention will become more apparent from the following detailed description which is to be read in conjunction with the attached drawings, in which.

DESCRIPTION OF THE PREFERRED EMBODIMENTS

Figure 1:
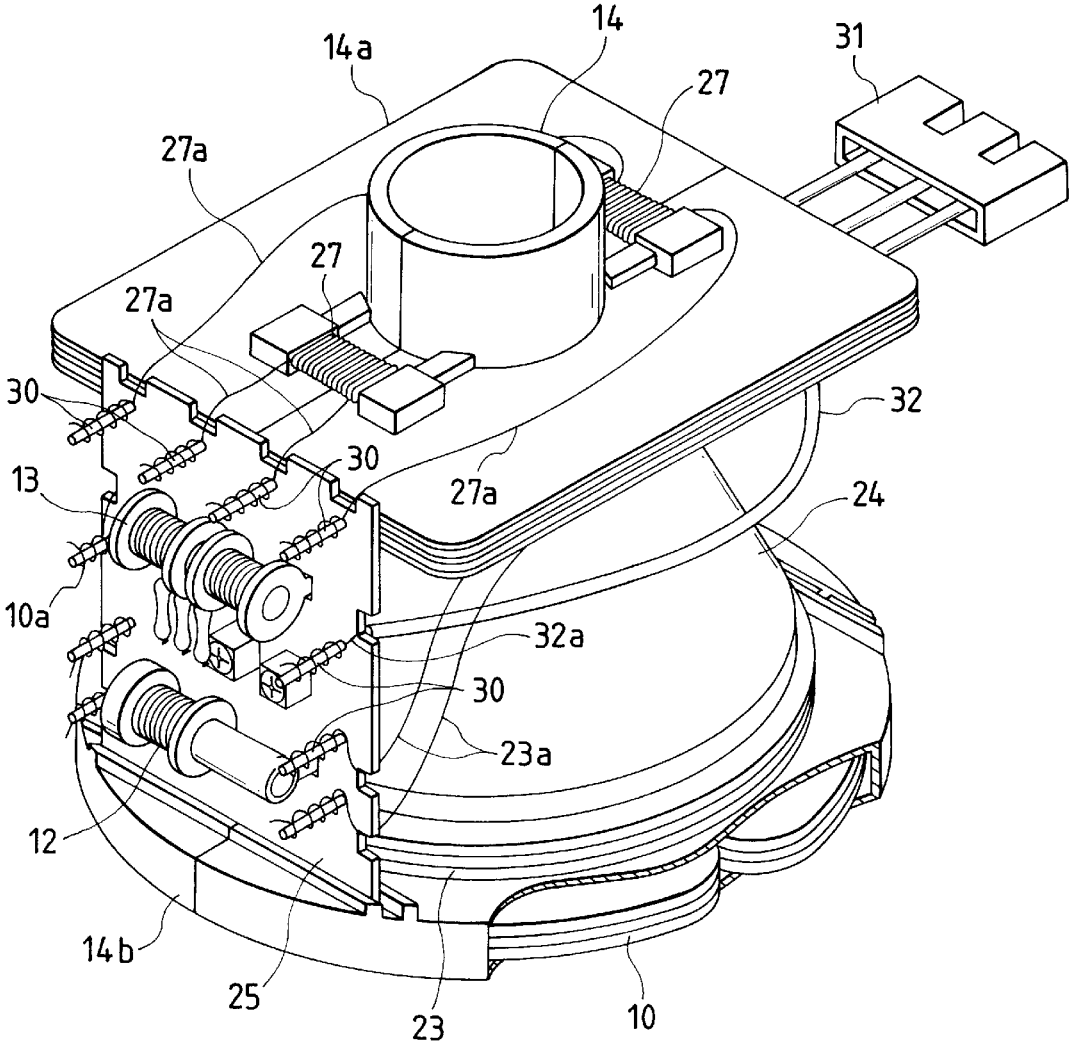
FIG. 1 is a partly broken perspective view showing a preferred embodiment of the deflection yoke in accordance with the present invention.

Hereinafter, preferred embodiments of the present invention will be explained with reference to the attached drawings. Identical parts are denoted by the same reference numerals throughout the views.

As shown in FIG. 1, the deflection yoke of this embodiment is configured into a funnel or bell-mouthed shape having one end (i.e., a lower end in the drawing) being a larger-diameter portion and the other end (i.e., an upper end in the drawing) being a smaller-diameter portion by assembling a pair of semicircular bodies of a separator 14. The larger-diameter portion is adjacent to a screen of the cathode ray tube (not shown) and the smaller-diameter portion is adjacent to a neck of the cathode ray tube (not shown).

The separator 14 accommodates a pair of saddle type horizontal deflection coils 10 along an inner surface thereof. Furthermore, the separator 14 mounts a pair of saddle type vertical deflection coils 23 along an outer surface thereof. The horizontal deflection coils 10 and the vertical deflection coils 23, held inside and outside the separator 14, are electrically insulated from each other. A core 24, being a ferrite or the like, is installed along an outer surface of the vertical deflection coils 23.

The separator 14 has one flange 14*a* provided at a predetermined portion adjacent to the neck of the cathode ray tube (hereinafter, referred to as a neck-side flange) and another flange 14*b* provided at an opposed portion adjacent to the screen of the cathode ray tube (hereinafter, referred to as a face-side flange). The neck-side flange 14*a* has a surface provided with a pair of four-polar correction coils 27 that are so-called 4P coils.

The deflection yoke is generally equipped with a correcting circuit for correcting the deflection characteristics. A substrate 25, provided at one side of the separator 14, mounts this kind of deflection characteristics correcting circuit. The substrate 25 mounts a differential coil 13 for correcting the convergence errors.

Furthermore, the substrate 25 mounts a plurality of pins 30 that protrude from the surface of the substrate 25 and serve as connecting terminals for winding leads 10*a* of the horizontal deflection coils 10, leads 23*a* of the vertical deflection coils 23, and leads 27*a* of the correction coils 27.

Furthermore, to supply electric current to the deflection yoke, a connector 31 is connected to an electric power source. A connector wire 32 is connected to the connector 31. A lead 32*a* of the connector wire 32 is also wound around the pin 30 of the substrate 25.

The substrate 25 mounts a variable inductance coil 12. Details of the arrangement and operation of this variable inductance coil 12 will be described later.

Figure 2:
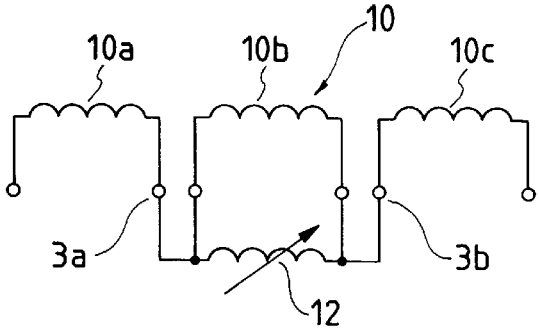
FIG. 2 is a circuit diagram showing a preferable circuit arrangement of a horizontal deflection coil of the deflection yoke in accordance with the present invention.

FIG. 2 is an arrangement of the horizontal deflection coil 10 in accordance with one embodiment of the present invention. Each horizontal deflection coil 10 consists of a total of three regions 10*a*, 10*b* and 10*c* connected in series from a winding introductory part to a winding terminal part thereof. An intermediate region 10*b* is connected in parallel with the variable inductance coil 12. This variable inductance coil 12 serves as a control means for controlling a horizontal deflection current flowing across the intermediate region 10*b*. According to the present invention, it is preferable that the horizontal deflection coil 10 is divided into three or more regions. By controlling the horizontal deflection current flowing across the intermediate region of the horizontal deflection coil 10, it becomes possible to eliminate the convergence error shown in FIG. 16. The number of turns in respective winding regions 10*a*, 10*b* and 10*c* can be adequately determined.

FIG. 2 shows only one of the paired upper and lower saddle type horizontal deflection coils 10. According to the circuit arrangement shown in FIG. 2, the horizontal deflection coil 10 has two intermediate taps 3*a* and 3*b*.

As explained in the foregoing description, the deflection yoke of the present invention divides a horizontal deflection coil into at least three regions extending from its winding introductory part to its winding terminal part. And, the control means is provided for controlling the horizontal deflection current flowing across the intermediate region of the horizontal deflection coil. With this arrangement, the XH convergence error is adequately corrected.

Figure 3:
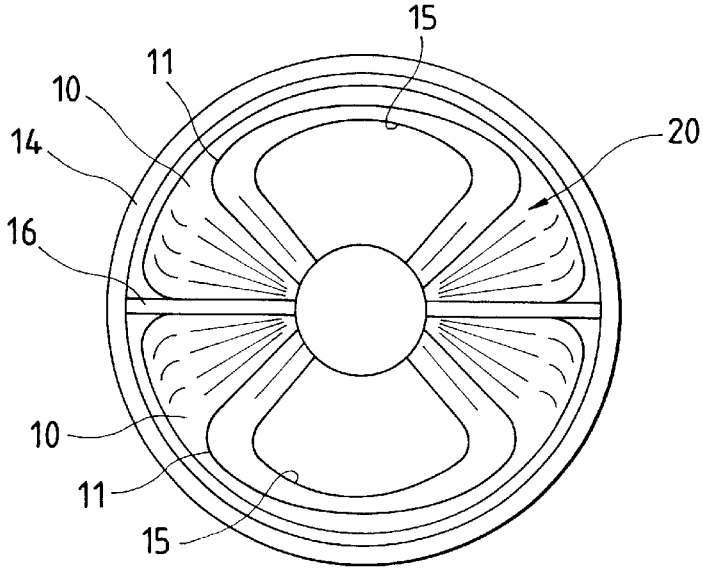
FIG. 3 is a plan view showing a preferable structural arrangement of the deflection yoke in accordance with the present invention.

FIG. 3 is a plan view showing a preferable structural arrangement of the deflection yoke in accordance with another aspect of the present invention. In FIG. 3, the funnel or bell-mouthed separator 14 accommodates the paired upper and lower horizontal defection coils 10 along an inner surface thereof. Each horizontal deflection coil 10 is formed into the saddle shape with the window 15. The upper and lower horizontal deflection coils 10 are opposed each other via a butt portion 16.

Each of the paired upper and lower horizontal deflection coils 10 has an intermediate portion between the winding introductory part and the winding terminal part, i.e., an intermediate region between an inner peripheral end of the horizontal deflection coil 10 adjacent to the window 15 and an outer peripheral end of the horizontal deflection coil 10. Auxiliary deflection coils 11 are disposed in the intermediate regions.

In other words, the auxiliary deflection coils 11 overlap with the horizontal deflection coils 10 in the region ranging from the inner peripheral portion of the horizontal deflection coil 10 adjacent to the window 15 to the outer peripheral portion of the of the horizontal deflection coil 10. The auxiliary deflection coils 11 can be disposed between the horizontal deflection coils 10 and the separator 14 if the condition is satisfied that the auxiliary deflection coils 11 overlap with the horizontal deflection coils 10 when seen in the plan view as shown in FIG. 3. In this respect, it is not always necessary to bring the auxiliary deflection coils 11 into contact with the horizontal deflection coils 10.

The horizontal deflection coils 10 and the auxiliary deflection coils 11 are collectively referred to as a horizontal winding portion 20. The auxiliary deflection coil 11 is wound during a winding operation of the corresponding horizontal deflection coil 10, as described later in detail. The number of turns in each auxiliary deflection coil 11 is one or two turns.

Figure 4:
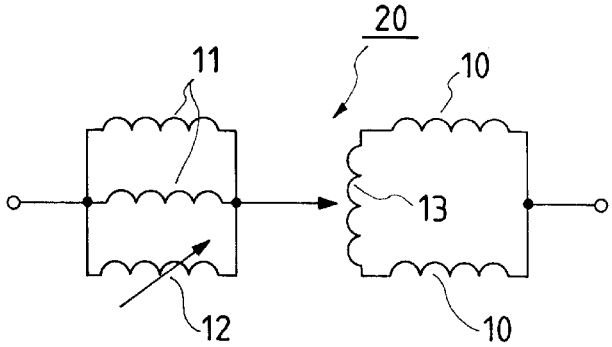
FIG. 4 is a circuit diagram showing a circuit arrangement of the deflection yoke shown in FIG. 3.

FIG. 4 shows a circuit arrangement of the deflection yoke shown in FIG. 3. As shown in FIG. 4, the paired upper and lower horizontal deflection coils 10 are connected in parallel with each other. Similarly, the paired upper and lower auxiliary deflection coils 11 are connected in parallel with each other. A differential coil 13 is serially connected between the paired upper and lower horizontal deflection coils 10 and the paired upper and lower auxiliary deflection coils 11. The differential coil 13 has no direct relationship with the present invention and, therefore, can be omitted.

Figure 13A:
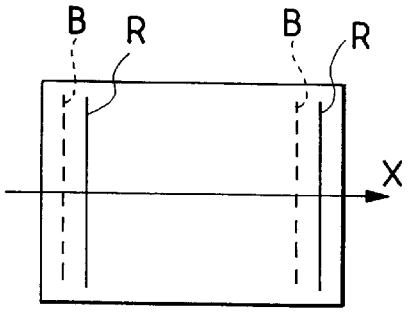
FIG. 13A PRIOR ART
FIGS. 13A and 13B are views showing typical XH convergence errors.
Figure 13B:
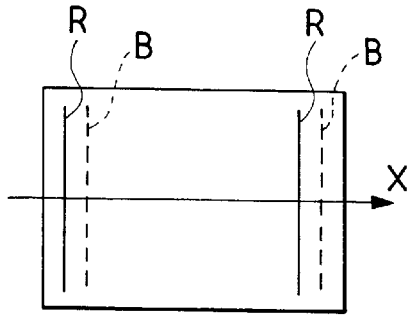
FIG. 13B PRIOR ART
Figure 14:
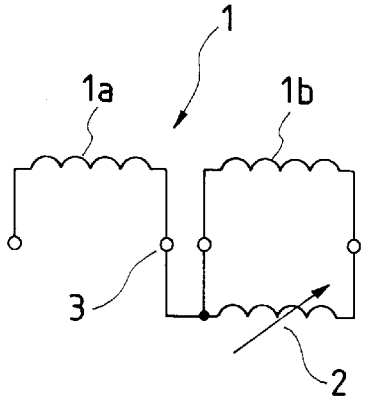
FIG. 14 PRIOR ART
FIG. 14 is a circuit diagram showing a conventional deflection yoke.
Figure 15:
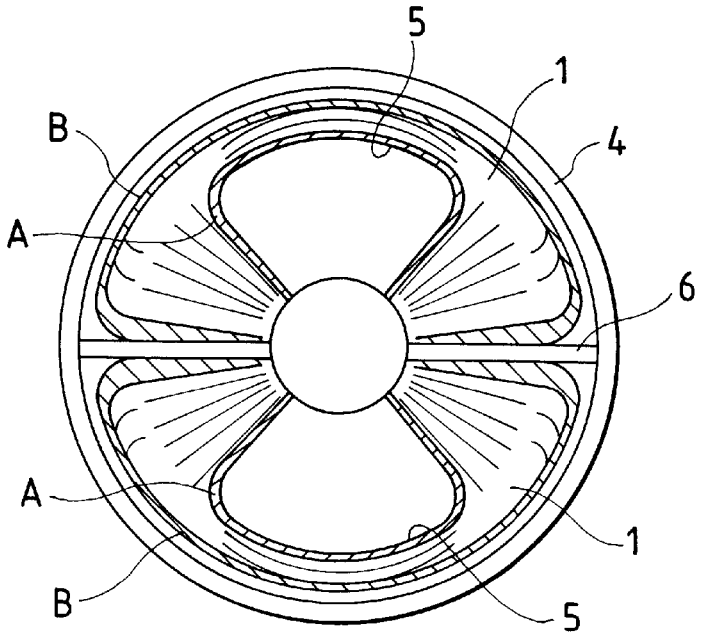
FIG. 15 PRIOR ART
FIG. 15 is a plan view showing the conventional deflection yoke shown in FIG. 14.

The variable inductance coil 12, having a function of adjusting the convergence, is connected in parallel with the auxiliary deflection coils 11. When the inductance of the variable inductance coil 12 decreases, the current flowing across the auxiliary deflection coil 11 decreases correspondingly. The pincushion of the horizontal deflection filed becomes strong. This makes it possible to correct the barrel type convergence error shown in FIG. 13B. On the contrary, by increasing the inductance of the variable inductance coil 12, it becomes possible to correct the pincushion type convergence error shown in FIG. 13A.

Figure 16:
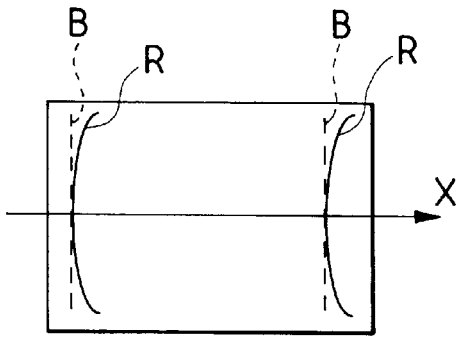
FIG. 16 PRIOR ART
FIG. 16 is a view showing a convergence error appearing in the conventional deflection yoke.

According to the above-described embodiment, the auxiliary deflection coil 11 is provided at an appropriate position in the intermediate portion of the corresponding horizontal deflection coil 10, so that the convergence error shown in FIG. 16 can be eliminated. As apparent from the foregoing description, the XH convergence error can be adequately corrected. The connection between the horizontal deflection coils 10 and the auxiliary deflection coils 11 is not limited to the one disclosed in FIG. 4. The means for controlling the current flowing across the auxiliary coils 11 is not limited to the variable inductance coil 12.

Figure 5:
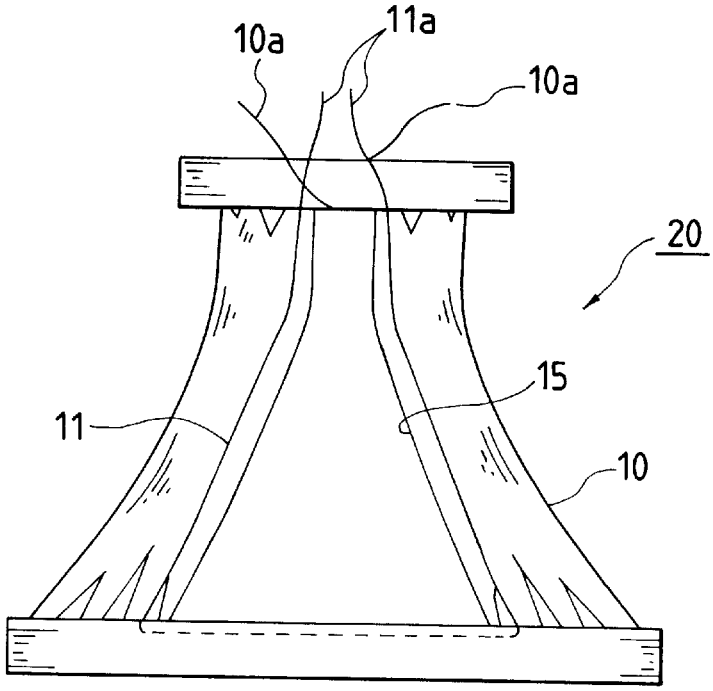
FIG. 5 is a side view showing a preferable structural arrangement of a horizontal winding portion of the deflection yoke shown in FIGS. 3 and 4.

Hereinafter, the horizontal winding portion 20 will be explained in greater detail. When the horizontal deflection coil 10 is wound by a winding machine (not shown), the winding operation usually starts from the inner peripheral end adjacent to the window 15. The winding operation of the horizontal deflection coil 10 advances toward the outer peripheral end from the inner peripheral end adjacent to the window 15. During this winding operation, the auxiliary deflection coil 11 is assembled with the horizontal deflection coil 10 in the intermediate region between the inner peripheral end adjacent to the window 15 and the outer peripheral end. FIG. 5 shows the horizontal winding portion 20 obtained by winding the auxiliary deflection coils 11 in addition to the horizontal deflection coils 10 in the above-described manner.

Figure 6A:
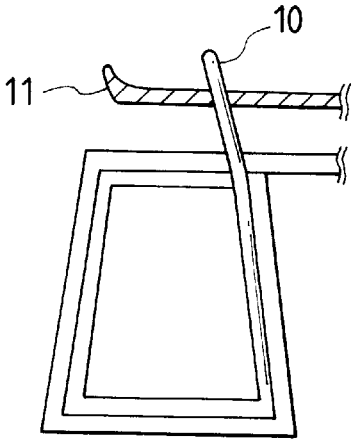
FIGS. 6A and 6B are views illustrating details of a winding operation of the horizontal winding portion of the deflection yoke shown in FIG. 5.
Figure 6B:
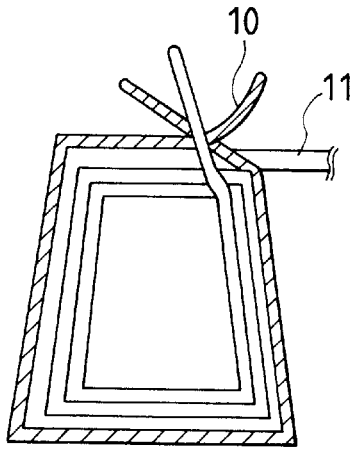

FIGS. 6A and 6B show details of the winding operation of the horizontal winding portion 20. First, as shown in FIG. 6A, only the horizontal deflection coil 10 is wound to constitute first and second turn sections. Then, as shown in FIG. 6B, the auxiliary deflection coil 11 is wound together with the horizontal deflection coil 10 by an amount equivalent to one turn along the third turn section of the horizontal deflection coil 10. When only one turn of the auxiliary deflection coil 11 is required, the winding operation of the auxiliary deflection coil 11 is terminated at this third turn section. Thereafter, only the horizontal deflection coil 10 is wound continuously to constitute the fourth and succeeding turn sections of the horizontal winding portion 20. If another turn of the auxiliary deflection coil 11 is required, the above-described winding operation of the first to third turn sections can repeated.

It is preferable to interrupt the winding operation of the winding machine at the transfer point from the singular winding operation using only the horizontal deflection coil 10 to the composite winding operation using both of the horizontal deflection coil 10 and the auxiliary deflection coil 11.

According to the above-described embodiment, the auxiliary deflection coil 11 is wound together or simultaneously with the corresponding horizontal deflection coil 10. However, it is also preferable to stop the winding operation of the horizontal deflection coil 10 when the auxiliary deflection coil 11 is wound. In this case, the auxiliary deflection coil 11 is wound independently of the horizontal deflection coil 10. After finishing the independent winding operation of the auxiliary deflection coil 11, the winding operation of the horizontal deflection coil 10 is restarted. In any cases, it is necessary to wind the auxiliary deflection coil 11 in the intermediate region of the horizontal winding portion 20 during the winding operation of the horizontal winding portion 20.

In short, the auxiliary deflection coil 11 is wound in addition to the horizontal deflection coil 10. However, the winding method of the auxiliary deflection coil 11 is not limited to the simultaneous winding method in which both the horizontal deflection coil and the auxiliary deflection coil are wound simultaneously. The present invention can be applied to all of winding methods wherein the auxiliary coil 11 is wound at an intermediate stage of the winding operation of the horizontal deflection coil 10. The auxiliary coil 11 can be disposed adjacent to the surface of the horizontal deflection coil 10 closer to the separator 14 or adjacent to the surface of the horizontal deflection coil 10 far from the separator 14. Alternatively, the auxiliary coil 11 can be disposed in the inside space of the horizontal deflection coil 10. Thus, the auxiliary deflection coil 11 interposes between the layers of the horizontal deflection coil 10 in an appearance where it is concealed by the horizontal deflection coil 10 or sandwiched between the layers of the horizontal deflection coil 10.

As shown in FIG. 5, the horizontal winding portion 20 has a total of four extension wires. Of four extension wires, two extension wires 10*a* are provided at the winding introductory part and the winding terminal part of the horizontal deflection coils 10. Two extension wires 11*a* are provided at the winding introductory part and the winding terminal part of the auxiliary deflection coils 11. The winding operation of the horizontal winding portion 20 can be automatically performed by the winding machine. There is no necessity of providing intermediate taps for the horizontal deflection coils 10. Two increased extension wires will not complicate the assembling work of the deflection yoke.

As explained in the foregoing description, the deflection yoke of the present invention comprises the auxiliary deflection coils 11 wound in addition to the horizontal deflection coils 10. When both the auxiliary deflection coils 11 and the horizontal deflection coils 10 are made of the same electric wire, it becomes difficult to discriminate the one from the other. Accordingly, it is desirable that the auxiliary deflection coils 11 is easily discriminatable from the horizontal deflection coils 10.

To this end, the electric wire used for the auxiliary deflection coils 11 is differentiated in color or wire diameter from the electric wire used for the horizontal deflection coils 10. Furthermore, when stranded electric wires are used for the auxiliary deflection coils 11 and the horizontal deflection coils 10, it is preferable to differentiate the strand pitches of these stranded electric wires from each other. It is also preferable to differentiate the electric wires in any possible combination among the color, the wire diameter and the strand pitch.

In this manner, at least one of the color, the wire diameter and the strand pitch of the electric wire used for the auxiliary deflection coils 11 is differentiated from that of the electric wire used for the horizontal deflection coils 10. This makes it possible to easily discriminate the auxiliary deflection coils 11 from the horizontal deflection coils 10. In the winding operation of the horizontal winding portion 20 or in the assembling work of the deflection yoke, it is surely prevented that the coils are mistakenly wound or assembled. The workability can be improved. Especially, it is extremely effective to differentiate the electric wires by color.

As explained in the foregoing description, the deflection yoke of the present invention comprises the paired auxiliary deflection coils connected to the horizontal deflection coils and wound with the horizontal deflection coils in the region from the window corresponding to the inner peripheral portion of the horizontal deflection coils to the outer peripheral portion of the horizontal deflection coils. The control means is provided for controlling the horizontal deflection current flowing across the auxiliary deflection coils. Furthermore, the winding method of the present invention winds the horizontal deflection coil in a cylindrical fashion from one end to the other end. The auxiliary deflection coils are connected to the horizontal deflection coils and wound with the horizontal deflection coils in the intermediate region between the one end and the other end. Accordingly, the XH convergence error is adequately corrected without complicating the assembling work of the deflection yoke.

Next, the arrangement of the variable inductance coil 12 will be explained with reference to FIG. 7. The variable inductance coil 12 comprises a bobbin 121 made of an insulating material such as a plastic resin. The bobbin 121 comprises a cylindrical core holding portion 121*a*, a winding portion 121*b*, and a disc core holding portion 121*c*. A flange 121*d* is provided between the cylindrical core holding portion 121*a* and the winding portion 121*b*. The bobbin 121 has a cylindrical hollow space 121*e* axially extending in the region corresponding to the cylindrical core holding portion 121*a* and the winding portion 121*b*.

An electric wire 122 is wound around the bobbin 121 in a region extending from the flange 121*d* to the disc core holding portion 121*c*, so as to form a coil 123 connected in parallel with the auxiliary deflection coils 11. A cylindrical core 124, being a ferrite or the like, is inserted in the hollow space 121*e* of the bobbin 121. The cylindrical core 124 has a cylindrical outer surface formed with a thread engageable with a corresponding thread formed on the inner cylindrical surface of the bobbin 121. Being guided by these threads, the cylindrical core 124 is shiftable along the axis of the hollow space 121*e* (i.e., a right-and-left direction in the drawing).

According to this arrangement, the cylindrical core holding portion 121*a* prevents the cylindrical core 124 from falling from the bobbin 121 even when the cylindrical core 124 is positioned at an edge of the winding portion 121*b*. The length of the cylindrical core 124 is substantially identical with a distance (i.e., winding width) "W" of the winding portion 121*b*. However, in necessary, the length of the cylindrical core 124 can be longer or shorter than the distance W of the winding portion 121*b*.

Furthermore, a disc core 125 is accommodated in the disc core holding portion 121*c* of the bobbin 121. The diameter of the disc core 125 is larger than the diameter of the cylindrical core 124. The disc core 125 is coaxial with the cylindrical core 124. An end face 124*a* of the cylindrical core 124 is opposed to an end face 125*a* of the disc core 125. According to this arrangement, the disc core 125 is accommodated in a closed space defined in the disc core holding portion 121*c*. A wall 121*c*1 of the disc core holding portion 121*c* interposes between the end face 124*a* of the cylindrical core 124 and the end face 125*a* of the disc core 125. Thus, the disc core 125 is positioned closely to the inner end of the hollow space 121*e* via the wall 121*c*1.

For example, the bobbin 121 of the variable inductance coil 12 can be formed by combining two half bodies. Each half body has a flat face extending in the longitudinal direction and being cut along a predetermined radial direction of the bobbin 121. First, both the cylindrical core 124 and the disc core 125 are installed at predetermined positions in the half body of the bobbin 121. Thereafter, while holding the cylindrical core 124 and the disc core 125, the two half bodies are assembled along their flat faces to obtain the variable inductance coil 12 as shown in FIG. 7. It may be preferable to joint the two half bodies by means of an appropriate hinge.

The inductance of the variable inductance coil 12 varies depending on a length "x" of a portion of the cylindrical core 124 inserted into the hollow space 121*e* of the winding portion 121*b*. The inductance of the variable inductance coil 12 is minimized when the cylindrical core 124 is pulled out of the hollow space 121*e* of the winding portion 121*b* (i.e., x=0) and maximized when the cylindrical core 124 is fully inserted in the hollow space 121*e* of the winding portion 121*b* (i.e., x=W). In FIG. 7, "n" represents the number of turns in the coil 123 and "S" represents a cross section of the cylindrical core 124 (i.e., an area of the end face 124*a*).

Figure 7:
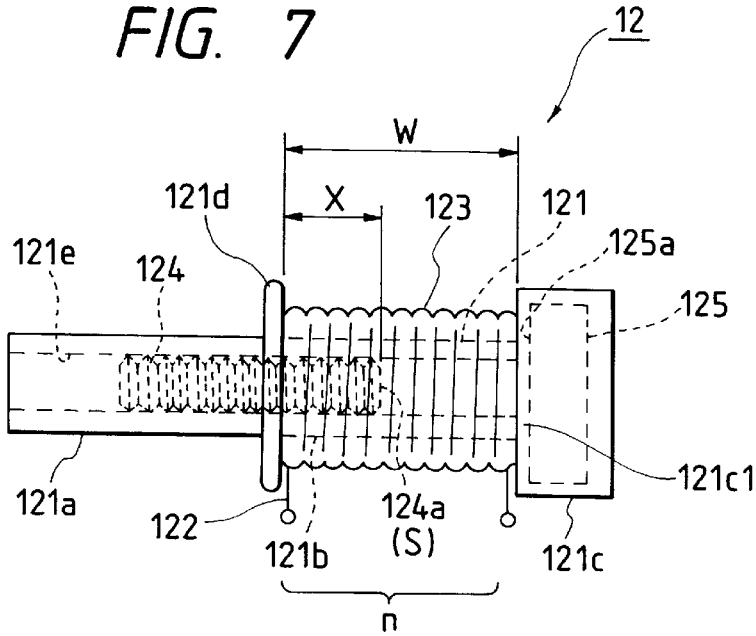
FIG. 7 is a side view showing a variable inductance coil shown in FIG. 1.
Figure 8:
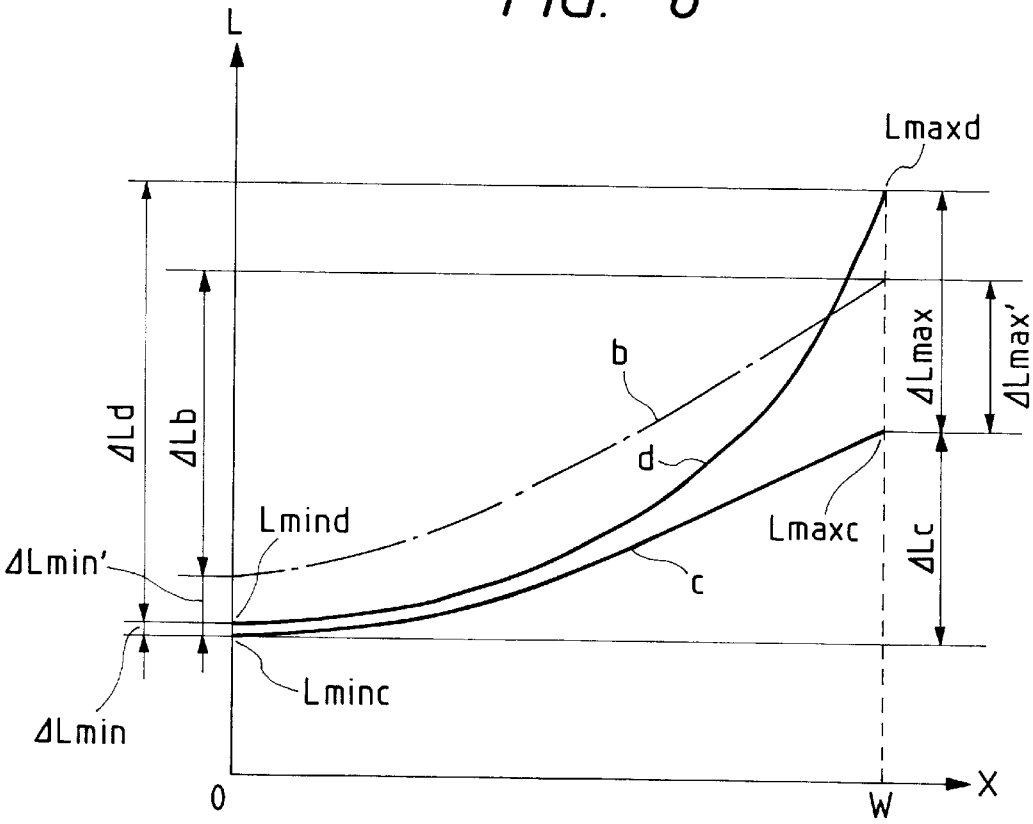
FIG. 8 is a graph explaining the characteristics of the deflection yoke of the present invention.

FIG. 8 shows a variation of the inductance L of the variable inductance coil 12 in response to a variation of the insertion amount "x" of the core 124. in FIG. 8, a characteristic curve "c" represents the variation of the inductance L found when the disc core 125 is removed from the variable inductance coil 12 shown in FIG. 7. Another characteristic curve "d" represents the variation of the inductance L found when the disc core 125 is inserted in the variable inductance coil 12 shown in FIG. 7.

The inductance L of the variable inductance coil 12 varies according to the characteristic curve "c" when the disc core 125 is removed from the variable inductance coil 12. The inductance L of the variable inductance coil 12 has a minimum value $L_{min}c$ when the insertion amount "x" of the cylindrical core 124 is 0 and has a maximum value $L_{max}c$ when the core insertion amount "x" is W. On the other hand, the inductance L of the variable inductance coil 12 varies according to the characteristic curve "d" when the disc core 125 is inserted in the variable inductance coil 12. The inductance L of the variable inductance coil 12 has a minimum value $L_{min}d$ when the insertion amount "x" of the cylindrical core 124 is 0 and has a maximum value $L_{max}d$ when the core insertion amount "x" is W. The characteristic curve "d" represents the performance of the variable inductance coil of the present invention.

According to the characteristic curve "c", the inductance L causes a variation ΔLc in response to the variation of the insertion amount "x" of the cylindrical core 124 from 0 to "W." According to the characteristic curve "d", the inductance L causes a variation ΔLd in response to the variation of the insertion amount "x" of the cylindrical core 124 from 0 to "W." When the insertion amount "x" of the cylindrical core 124 is 0, the inductance L increases by ΔLmin by the provision of the disc core 125. When the insertion amount "x" of the cylindrical core 124 is W, the inductance L increases by ΔLmax by the provision of the disc core 125.

As understood from FIG. 8, when the cylindrical core 124 is not inserted into the hollow space 121*e* of the winding portion 121*b*, a very small increase ΔLmin in the inductance L is obtained by the provision of the disc core 125. On the other hand, when the cylindrical core 124 is inserted into the hollow space 121*e* of the winding portion 121*b*, a very large increase ΔLmax in the inductance L is obtained by the provision of the disc core 125. The increase ΔLmax is fairly larger than the increase ΔLmin.

When the disc core 125 is not provided, the increase of inductance L is linear as shown by the characteristic curve "c". On the contrary, when the disc core 125 is installed in the variable inductance coil 12, the increase of inductance L is quadratic as shown by the characteristic curve "d".

In FIG. 8, an alternate long and short dash line represents a comparative characteristic curve "b" that is obtained by solely increasing the turn number of the coil 123. According to the characteristic curve "b", the inductance L causes a variation ΔLb in response to the variation of the insertion amount "x" of the cylindrical core 124 from 0 to "W." When the insertion amount "x" of the core 124 is 0, the inductance L increases by ΔLmin' in response to an increase in the number of turns in the coil 123. When the insertion amount "x" of the core 124 is W, the inductance L increases by ΔLmax' in response to the turn number increase in the coil 123.

As apparent from the comparison between the characteristic curves "b" and "d", the variable inductance coil 12 of the present invention can change the inductance L in a wide variation range (ΔLd) without increasing the turn number of the coil 123. Furthermore, the variation range obtained by the present invention is larger than the variation range (ΔLb) obtained by the increase in the number of turns in the coil 123.

The following is detailed dimensions of the coil 123 of the variable inductance coil 12 as a preferable embodiment of the present invention. The turn number "n" of the coil 123 is 48. The winding width "W" is 24 mm. The area "S" of the end face 124*a* of the cylindrical core 124 is 130 to 150 $mm^2$. When the disc core 125 is not installed in the variable induction coil 12, a realized variation in the inductance L is very small as shown by the characteristic curve "c." This will bring a unsatisfactory result in the correction of the XH convergence error. On the other hand, when the disc core 125 is installed in the variable induction coil 12, a large variation range is realized in the inductance L as shown by the characteristic curve "d." It is confirmed that this brings a satisfactory result in the correction of the XH convergence error. The diameter of the disc core 125 is 15 mm, and the thickness is 3.5 mm.

As apparent from the foregoing description, the present invention provides the variable inductance coil connected in parallel with the auxiliary deflection coils 11 for adjusting the convergence. In view of the fact that the XH convergence error cannot be corrected satisfactorily by solely increasing the turn number of the coil, the inventors of the present invention propose to use the additional core, e.g., the disc core 125, other than the cylindrical core 124. The diameter of this additional core is larger than the diameter of the cylindrical core 124. With the arrangement, the XH convergence error can be corrected satisfactorily.

The variable inductance coil 12 of the present invention is not limited to the one disclosed in FIG. 7 and, therefore, can be modified in various ways. Other preferable arrangements of the variable inductance coil 12 will be explained hereinafter with reference to FIGS. 9A to 12B.

Figure 9B:
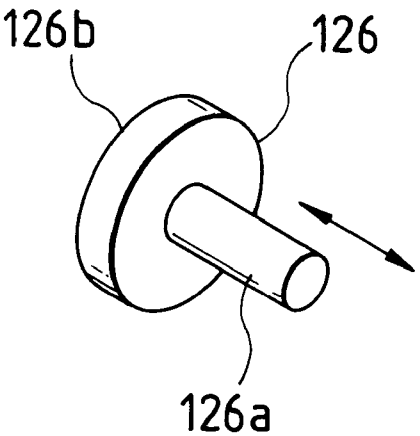
FIGS. 9A and 9B are views showing another arrangement of the variable inductance coil shown in FIG. 1.
Figure 9A:
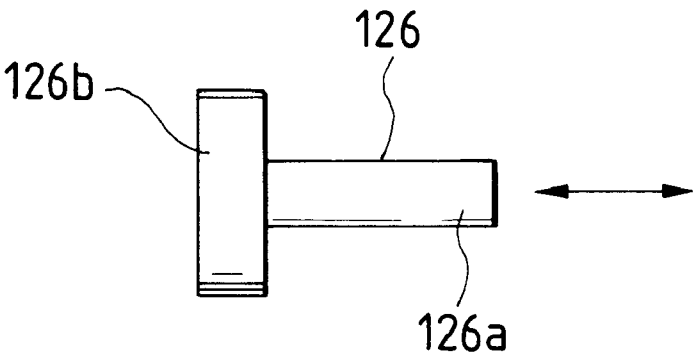

In FIG. 7, when the cylindrical core 124 is positioned at an innermost end of the winding portion 121*b*, the distance between the end face 124*a* of the cylindrical core 124 and the end face 125*a* of the disc core 125 is minimized. The inductance L and ΔLmax can be increased by reducing this distance. To realize this, FIGS. 9A and 9B cooperatively show a T-shaped core 126 as an embodiment integrating the cylindrical core 124 and the disc core 125. FIG. 9A shows a side view showing the T-shaped core 126. FIG. 9B shows a perspective view showing the T-shaped core 126.

The T-shaped core 126 comprises a cylindrical portion 126*a* and a disc portion 126*b*. A thread (not shown in the drawing) is formed on either the cylindrical portion 126*a* or the disc portion 126*b*. The cylindrical portion 126*a* is inserted into the hollow space 121*e* of the winding portion 121*b*. The T-shaped core 126 is slidable in a direction shown by an arrow to adjust the XH convergence error. The cylindrical core holding portion 121*a* has a larger diameter sufficient to accommodate the disc portion 126*b*.

Figure 10B:
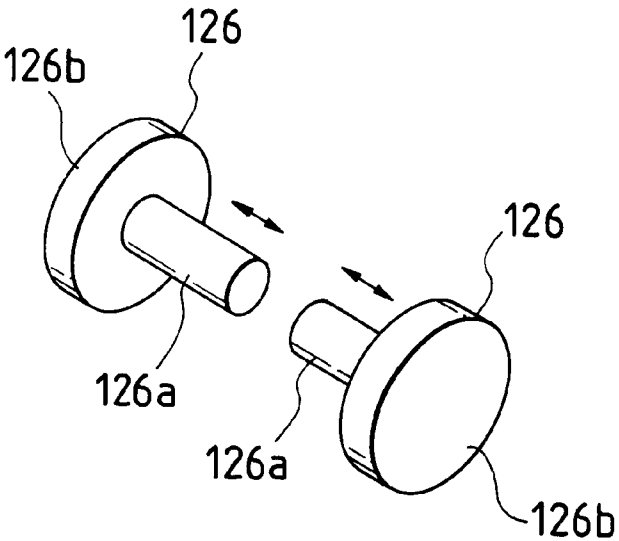
FIGS. 10A and 10B are views showing another arrangement of the variable inductance coil shown in FIG. 1.
Figure 10A:
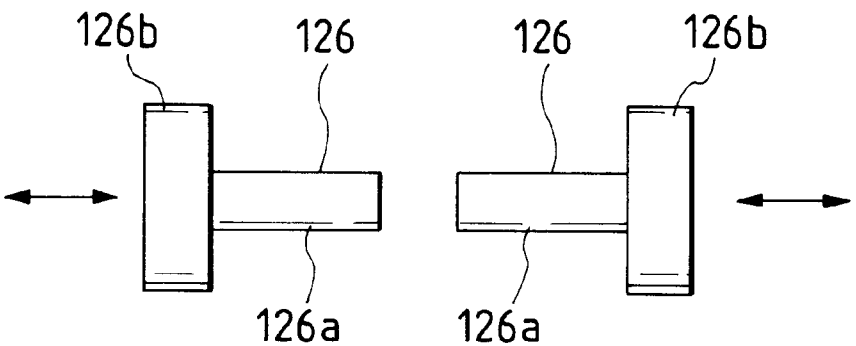

FIGS. 10A and 10B show another embodiment using two T-shaped cores 126. FIG. 10A is a side view and FIG. 10B is a perspective view showing the layout of the two T-shaped cores 126. The cylindrical portions 126*a* of two T-shaped cores 126 are opposed each other. These T-shaped cores 126 are slidable in a direction shown by an arrow to adjust the XH convergence error. The cylindrical core holding portion 121*a* has a larger diameter sufficient to accommodate the disc portion 126*b*. Two cylindrical core holding portions 121*a* are provided for accommodating the disc portions 126*a* of the T-shaped cores 126, respectively.

Figure 11B:
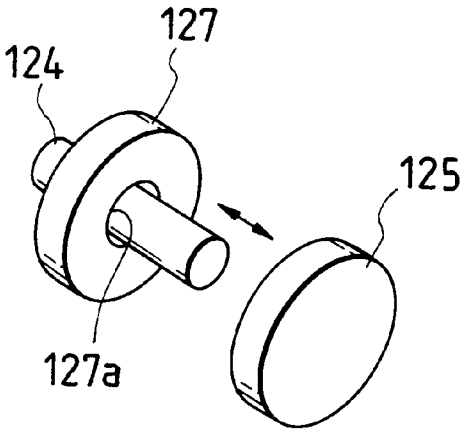
FIGS. 11A and 11B are views showing another arrangement of the variable inductance coil shown in FIG. 1.
Figure 11A:
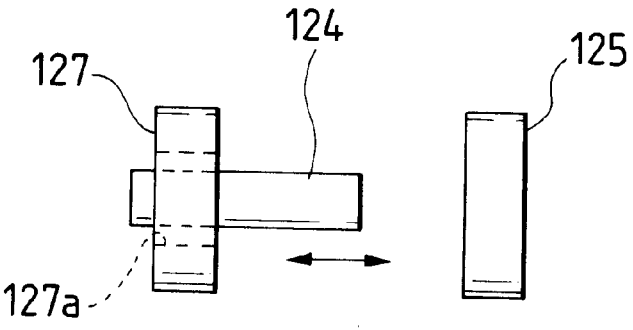

FIGS. 11A and 11B show another embodiment using a ring core 127 having a through hole 127*a* formed at a center thereof that is assembled with the cylindrical core 124 and the disc core 125 shown in FIG. 7. FIG. 11A is a side view and FIG. 11B is a perspective view showing the layout of the ring core 127. The cylindrical core 124 is inserted into the through hole 127*a* of the ring core 127. The cylindrical core 124 is slidable in a direction shown by an arrow to adjust the XH convergence error.

Figure 12B:
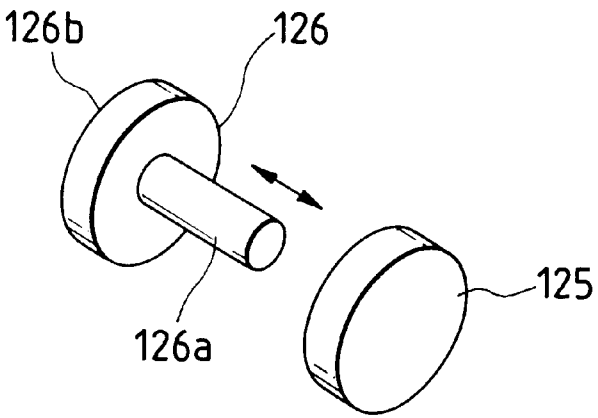
FIGS. 12A and 12B are views showing another arrangement of the variable inductance coil shown in FIG. 1.
Figure 12A:
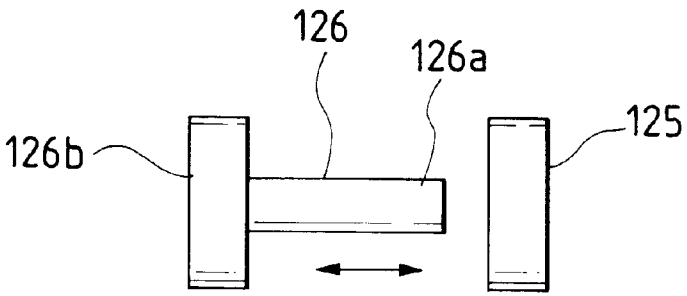

FIGS. 12A and 12B show another embodiment combining the T-shaped core 126 and the disc core 125. FIG. 12A is a side view and FIG. 12B is a perspective view showing the layout o the combined T-shaped core 126 and disc core 125. The T-shaped core 126 is slidable in a direction shown by an arrow to adjust the XH convergence error.

As explained in the foregoing description, the variable inductance coil 12 of the present invention comprises a first core (e.g., the cylindrical core 124) installed in the hollow space 121*e* of the winding portion 121*b*. Furthermore, the variable inductance coil 12 of the present invention comprises a second core that has an end face having an area larger than the area "S" of the end face 124*a* of the cylindrical core 124. The first core and the second core can be formed integrally or separately.

According to the arrangement shown in FIG. 7, the cylindrical core 124 is formed as a separate member independent of the disc core 125. When the cylindrical core 124 approaches the disc core 125, the gradient in the increase of inductance L becomes large. The XH convergence error correction is performed by shifting the cylindrical core 124 in the hollow space 121*e*. An excessively large gradient in the increase of the inductance L may complicate the adjustment in the correction of the XH convergence error. In such a case, it is preferable to place the disc core 125 farther from the end portion of the winding portion 121*b* so as to increase the shortest distance between the cylindrical core 124 and the disc core 125. Alternatively, it is preferable to separate the cylindrical core 124 from the disc core 125 by the wall 121*c*1 of the disc core holding portion 121*c* as explained in the above-described embodiment.

On the contrary, it may be necessary to increase the gradient in the increase of the inductance L. In such a case, it is preferable to omit the wall 121*c*1 of the disc core holding portion 121*c*. Alternatively, it is preferable to provide a through hole on the wall 121*c*1 into which the cylindrical core 124 is inserted so as to decrease the shortest distance between the cylindrical core 124 and the disc core 125. The arrangement separately providing the cylindrical core 124 and the disc core 125 is advantageous in that the above-described adjustment can be done flexibly.

According to the above-described embodiment, the additional core (e.g., the disc core 125) has an end face larger in the area that the end face 124*a* of the cylindrical core 124. However, the configuration of the additional core is not limited to a disc and, therefore, can be triangular or rectangular. Preferably, the cylindrical core 124 is disposed coaxially with the additional core. However, it is allowable to axially offset or obliquely dispose the one with respect to the other when the effects of the present invention are obtained. Furthermore, according to the present invention, the cylindrical core 124 is provided with the thread to slidably guide the cylindrical core 124 along the axis of the hollow space 121*e*. However, the shifting mechanism of the cylindrical core 124 is not limited to the disclosed one. Therefore, the present invention can be applied to any other shifting mechanism not relying on the thread. The core installed in the hollow space 121*e* is generally cylindrical. However, a non-cylindrical core can be used in the present invention.

As apparent from the foregoing description, the present invention is not limited to the disclosed embodiments and therefore can be modified in various ways within the scope of the present invention. Furthermore, it is possible to apply the arrangement of the present invention to any correction coils including the differential coil 13.

As explained in the foregoing description, the deflection yoke of the present invention is equipped with the variable inductance coil comprising the bobbin having the hollow space, the first core installed in the hollow space of the bobbin and shiftable in the longitudinal direction of the hollow space, and the coil connected in parallel with the auxiliary deflection coil and wound around the bobbin, characterized by the second core that is independent of the first core and having the end surface larger in area than the end surface of the first core, and the second core being disposed adjacent to an end portion of the hollow space. Alternatively, the second core is integral with the first core and having the end surface larger in area than the end surface of the first core. According to the present invention, the XH convergence error can be satisfactorily corrected with a sufficiently enlarged variable range in the inductance without increasing the turn number of the coil or the length of the core unnecessarily.

The present invention can be applied to a so-called saddle-saddle type deflection yoke comprising the saddle type horizontal deflection coils and the saddle type vertical deflection coils, as well as a so-called saddle-toroidal type deflection yoke comprising the saddle type horizontal deflection coils and the toroidal vertical deflections coils.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A deflection yoke comprising:

at least one saddle type horizontal deflection coil, said horizontal deflection coil having at least three regions extending from a winding introductory part to a winding terminal part; and a control means for controlling a horizontal deflection current flowing across a predetermined intermediate region of said horizontal deflection coil;

wherein said control means is a variable inductance coil connected in parallel with said intermediate region of said horizontal deflection coil.

2. A deflection yoke comprising:

a pair of saddle type horizontal deflection coils, and a pair of auxiliary deflection coils connected to said horizontal deflection coils and disposed in a region between an inner peripheral portion of said horizontal deflection coils adjacent to a window of the yoke and an outer peripheral portion of said horizontal deflection coils.

3. The deflection yoke in accordance with claim 2, wherein said auxiliary deflection coils are disposed in a space defined by the horizontal deflection coils.

4. The deflection yoke in accordance with claim 2, further comprising a control means for controlling a horizontal deflection current flowing across said auxiliary deflection coils.

5. The deflection yoke in accordance with claim 4, wherein said control means is a variable inductance coil connected in parallel with said auxiliary deflection coils.

* * * * *